US005729099A

United States Patent [19]

Yamane et al.

[11] Patent Number: 5,729,099

[45] Date of Patent: Mar. 17, 1998

[54] ELECTRON GUN HAVING IMPROVED FOCUS AND CONVERGENCE, AND COLOR CATHODE-RAY TUBE AND IMAGE DISPLAY DEVICE

[75] Inventors: Hisakazu Yamane, Nagaokakyo; Souichirou Okuda; Tadahisa Yoshida, both of Amagasaki, all of Japan

[73] Assignee: Mitsubishi Denki Kabushiki Kaisha, Tokyo, Japan

[21] Appl. No.: 651,126

[22] Filed: May 21, 1996

Related U.S. Application Data

[63] Continuation of Ser. No. 225,701, Apr. 11, 1994, abandoned.

[30] Foreign Application Priority Data

Aug. 3, 1993 [JP] Japan ..... 5-192349

[51] Int. Cl.[6] ..... H01J 29/58

[52] U.S. Cl. ..... 315/382; 315/14; 313/414

[58] Field of Search ..... 315/382, 368, 315/15, 14, 368.11, 368.15, 368.16; 313/414, 449, 428, 412, 413

[56] References Cited

U.S. PATENT DOCUMENTS

| | | | |
|---|---|---|---|
| 4,498,026 | 2/1985 | Yamauchi et al. | 313/414 |
| 4,771,216 | 9/1988 | Blacker et al. | 315/382 |
| 4,772,827 | 9/1988 | Osakabe | 315/382 |
| 4,886,999 | 12/1989 | Yamane et al. | 313/414 |
| 4,899,091 | 2/1990 | Odenthal | 315/382 |
| 4,940,917 | 7/1990 | Stil | 313/414 |
| 5,015,910 | 5/1991 | Takahashi et al. | 313/414 |

*Primary Examiner*—Robert Pascal
*Assistant Examiner*—David Vu

[57] ABSTRACT

In an electron gun, and a color cathode-ray tube and an image display device using the electron gun, each of two pairs of convergence electrodes is disposed in a focusing electrode for focusing three electron beams in a manner to pass the respective side beam of the three electron beams. Since an alternating current voltage synchronized with a deflection current is superposed to one of each pair of the convergence electrodes, such forces are exerted to the side beams as to separate the side beams from each other in the vicinity of the peripheral edge of a screen having a fluorescent body, so that the converging point of the electron beams is positioned on the screen. The focusing function of a main electron lens is weakened in the vicinity of the peripheral edge of the screen, whereby the electron beams are correctly focused.

18 Claims, 14 Drawing Sheets

ELECTRON GUN HAVING IMPROVED FOCUS AND CONVERGENCE, AND COLOR CATHODE-RAY TUBE AND IMAGE DISPLAY DEVICE

This application is a continuation of application Ser. No. 08/225,701 filed on Apr. 11, 1994, now abandoned.

BACKGROUND OF THE INVENTION

1. Field of the Invention

The invention relates to a color cathode-ray tube and an image display device in which three emitted electron beams are focused and deflected to be scanned on a fluorescent screen, and also to an electron gun for emitting the electron beams.

2. Description of the Related Art

FIG. 1 is a schematic section view showing the configuration of a color cathode-ray tube which uses a prior art electron gun. In the figure, 109 indicates a glass envelope. An inner duck 108 is formed inside a funnel portion of the glass envelope 109, and a face plate 112 is disposed at the opening of the funnel portion. An electron gun 100 is set at the neck portion of the glass envelope 109. A cathode 101 attached to the opening of the neck portion consists of three cathodes which are heated by a heater (not shown) to emit electrons, namely, a cathode 101*a* for generating a RED beam 113, a cathode 101*b* for generating a GREEN beam 114, and a cathode 101*c* for generating a BLUE beam 115. At the emission side of the cathode 101, a G1 electrode 102 for controlling the quantity of the emitted electron beams, a G2 electrode 103 for accelerating the controlled electron beams, a G3 electrode 104 for focusing accelerated electron beams, a G4 electrode 105, and a shield cup 106 are arranged in this sequence. The G3 electrode 104 and the G4 electrode 105 constitute a main electron lens for focusing the electron beams. The G4 electrode 105 and the shield cup 106 are welded to be electrically connected each other, and a high voltage of about 20 to 35 kV is applied to the G4 electrode 105 from an anode button which is not shown through the inner duck 108. The cathode 101, the G1 electrode 102, the G2 electrode 103, the G3 electrode 104, the G4 electrode 105, and the shield cup 106 constitute the electron gun 100.

A Fluorescent material 111 which emits light of colors upon receipt of the RED beam 113, the GREEN beam 114, and the BLUE beam 115 is formed inside the face plate 112. A mosaic shadow mask 110 is provided inside the fluorescent material to be opposite to the face plate 112. A deflection yoke 107 for scanning the electron beams is attached in the outer periphery of the boundary between the neck portion of the glass envelope 109 and the funnel portion.

Next, the state of the electron beams in the thus constructed color cathode-ray tube will be described. The three electron beams emitted from the cathode 101 are controlled in the amount of electrons by the G1 electrode 102, and accelerated by the G2 electrode 103. Then, the electron beams receive the focusing action of the main electron lens constituted of the G3 electrode 104 and the G4 electrode 105, so that a converged light spot is formed on the face plate 112. In this process, the three electron beams 113, 114 and 115 are adjusted by an external magnet, etc. so as to be converged onto one point at the central part of the face plate 112.

FIGS. 2A, 2B and 2C are diagrams illustrating the converging and focusing actions on electron beams to which an inhomogeneous magnetic field is applied, and FIGS. 3A, 3B and 3C are diagrams of the converging and focusing actions on electron beams to which a homogeneous magnetic field is applied. Generally, the magnetic field due to the deflection yoke 107 is inhomogeneously distorted so that a horizontally deflected magnetic field 116*a* assumes a pincushion-like shape and a vertically deflected magnetic field 117*a* shows a barrel-like shape as is clear from FIG. 2A illustrating the magnetic field due to the deflection yoke. This is intended to correct the converging point of the three electron beams. For instance, when the electron beams are deflected by a homogeneous magnetic field as in FIG. 3A which is explanatory of a magnetic field due to the deflection yoke, the converging point of the three electron beams traces a curve 118 (the circumference of a circle) as shown in FIG. 3B. In the vicinity of the peripheral edge of the face plate 112, the converging point is focused at a position 120 in front of the face plate 112 and greatly separated from the face plate 112. As a result, the converging point is deviated large from an originally intended position 121 shown in FIG. 2B. This causes the distance between the electron gun 100 and the face plate 112 to be increased further in the peripheral edge of the face plate 112 as is apparent from FIG. 3C which depicts beam spots projected to the face plate 112, and therefore giving rise to a portion (halo 123*a*) over focused as a whole and deteriorating the resolution.

In order to prevent the above inconvenient phenomenon, as shown in FIG. 2B illustrating the converging and focusing actions on electron beams, an inhomogeneous magnetic field due to the deflection yoke 107 is used so as to form the converging point of the three electron beams at the position 121 close to the face plate 112. In the case where an inhomogeneous magnetic field is used, however, the beam spot is vertically divided into the halo 123*a* and a core 123*b* in the vicinity of the peripheral edge of the face plate 112, as indicated in FIG. 2C illustrating beam spots projected to the face plate, similar to FIG. 3C. Since the halo 123*a*, which is low in luminance, is extended in the vertical direction, the diameter of the beam spot is distorted as a whole and the resolution in the vicinity of the peripheral edge of the face plate 112 is impaired.

In order to solve this problem, according to a proposed device using a homogeneous magnetic field, when a homogeneous magnetic field is applied by a deflection yoke, the distortion of the spot diameter in the vicinity of the peripheral edge of the face plate 112 is prevented. However, there still remain two problems described above without being solved, that is, the converging point 120 of the three electron beams in the vicinity of the peripheral edge of the face plate 112 is located in front of and separated from the face plate 112 and hence the convergence in missed on the face plate 112, and, since the distance between the electron gun 100 and the face plate 112 is increased as the beam spot projected to the face plate 112 comes closer to the peripheral edge, the over focused portion (halo 123*a*) is generated and tile resolution is decreased. These problems are solved in a manner described below.

FIG. 4A is a plan view showing the configuration of a device for executing the motion convergence of a color cathode-ray tube, and FIG. 4B is a section view taken along the line IV—IV of FIG. 4A. 125 is a A magnetic pole piece 125 inserted into the shield cup 106 to hold the side electron beam 113 or 115 there between. Two ferrite cores 126 with coils 127 wound are disposed outside a neck glass 124 accommodating the electron gun therein in a manner to face each other via the neck glass 124. The ferrite cores 126 supply to the pole pieces 125 a current $i_1$ synchronized with the deflection current, thereby generating forces (indicated by arrows 128) to separate the side beams 113 and 115 from each other in the vicinity of the peripheral edge of the face plate 112. As a result, even in the vicinity of the peripheral edge of the face plate 112, the three electron beams are converged at a position close to the face plate 112 and separated little from the face plate 112.

In order to correct the over focused state in the vicinity of the peripheral edge of the face plate 112, furthermore, an alternating current voltage (AC) synchronized with the deflection current is applied. FIG. 5A is a diagram illustrating the dynamic focusing function in a color cathode-ray tube, and FIG. 5B is an explanatory diagram of the alternating current voltage (AC) which is superposed to the G3 electrode. The effect of the main electron lens 129 in the vicinity of the peripheral edge of the face plate 112 is reduced by applying the alternating current voltage (AC) synchronized with the deflection current to the G3 electrode 104 (DC+AC), whereby an over focused electron current 131 is corrected to an electron current 132 which is correctly focused even in the vicinity of the peripheral edge of the face plate 112.

As described above, correcting the amount of the missed convergence requires the alternating current voltage applied to the G3 electrode to be synchronized with the deflection current. The reason will be described. The amount of the missed convergence of the three electron beams is proportional to the deflecting degree of the electron beams, and the deflection degree of the electron beams is proportional to the level of the deflection current supplied to the deflection yoke. Accordingly, during the period when the electron beams are deflected to the vicinity of the peripheral edge of the face plate 112, i.e., the deflecting degree of the electron beams is large, it is required to superpose an alternating current voltage corresponding to the deflection current.

FIGS. 6A and 6B are diagrams showing the state of electron beams subjected to the motion convergence action and the dynamic focusing action according to the method described above. As shown in FIG. 6A illustrating the converging and focusing actions on the electron beams, the three electron beams 113 to 115 can be converged at a predetermined position in the whole area of the face plate. At the same time, as indicated in FIG. 6B similar to FIGS. 2C and 3C, the three electron beams 113 to 115 are cast in focus in the whole area of the face place. A color cathode-ray tube without the deterioration of resolution is thus obtained.

In the above-described prior art color cathode-ray tube and electron gun, the missed convergence of electron beams in the vicinity of the peripheral edge of the face plate 112 is corrected by the arrangement of convergence correction using pole pieces (hereinafter, referred to as "motion convergence correction"), and the over focused electron current is solved by superposing an alternating current voltage to the G3 electrode. Therefore, the whole structure of the device including circuits becomes complicated and is difficult to adjust. Moreover, the motion convergence correction necessitates large electric power.

SUMMARY OF THE INVENTION

The invention has been conducted in order to solve the above-discussed problems. It is an object of the invention to provide an electron gun, a color cathode-ray tube and an image display device which are simple in structure, and enable easy adjustment of the converging and focusing actions on electron beams with less power consumption.

The electron gun, color cathode-ray tube and image display device of the invention comprise a cathode for emitting three electron beams, a focusing electrode for focusing the electron beams, and pairs of convergence electrodes which are installed in the focusing electrode in such a manner as to hold the side electron beams of the three electron beams therebetween. An alternating current voltage which is synchronized with the deflection current for deflecting the electron beams is superposed to one electrode of each pair of convergence electrodes by an alternating current voltage generating circuit. Therefore, in the presence of a homogeneous magnetic field, when the alternating current voltage is applied to the convergence electrodes which are to be electrically connected to the focusing electrode constituting the main electron lens, such forces are produced as to separate the side beams from each other, and the focusing function of the main electron lens is weakened in the vicinity of the peripheral edge of the screen, so that the electron current is properly focused even in the vicinity of the peripheral edge of the screen.

The electron gun, color cathode-ray tube and image display device of the invention may further comprise sets of four electrodes in the focusing electrode so as to enclose the three electron beams square, wherein an alternating current voltage synchronized with the deflection current is superposed to one of each pair of confronting electrodes by the alternating current voltage generating circuit. Accordingly, a force is produced so that the action as a quadrupole lens due to the convergence electrodes which causes the beam spot to be distorted is canceled.

The electron gun, color cathode-ray tube and image display device of the invention may further comprise a pair of correction electrodes in the focusing electrode to hold the center beam of the three electron beams therebetween, and an alternating current voltage synchronized with the deflection current is superposed to the correction electrodes. Accordingly, a force which cancels the difference in level between the center beam and the side beams because of the action as a quadrupole lens is produced.

The above and further objects and features of the invention will more fully be apparent from the following detailed description with accompanying drawings.

DESCRIPTION OF THE PREFERRED EMBODIMENTS

Hereinafter, the invention will be described with reference to the drawings showing the embodiments.

Embodiment 1

Figure 1:
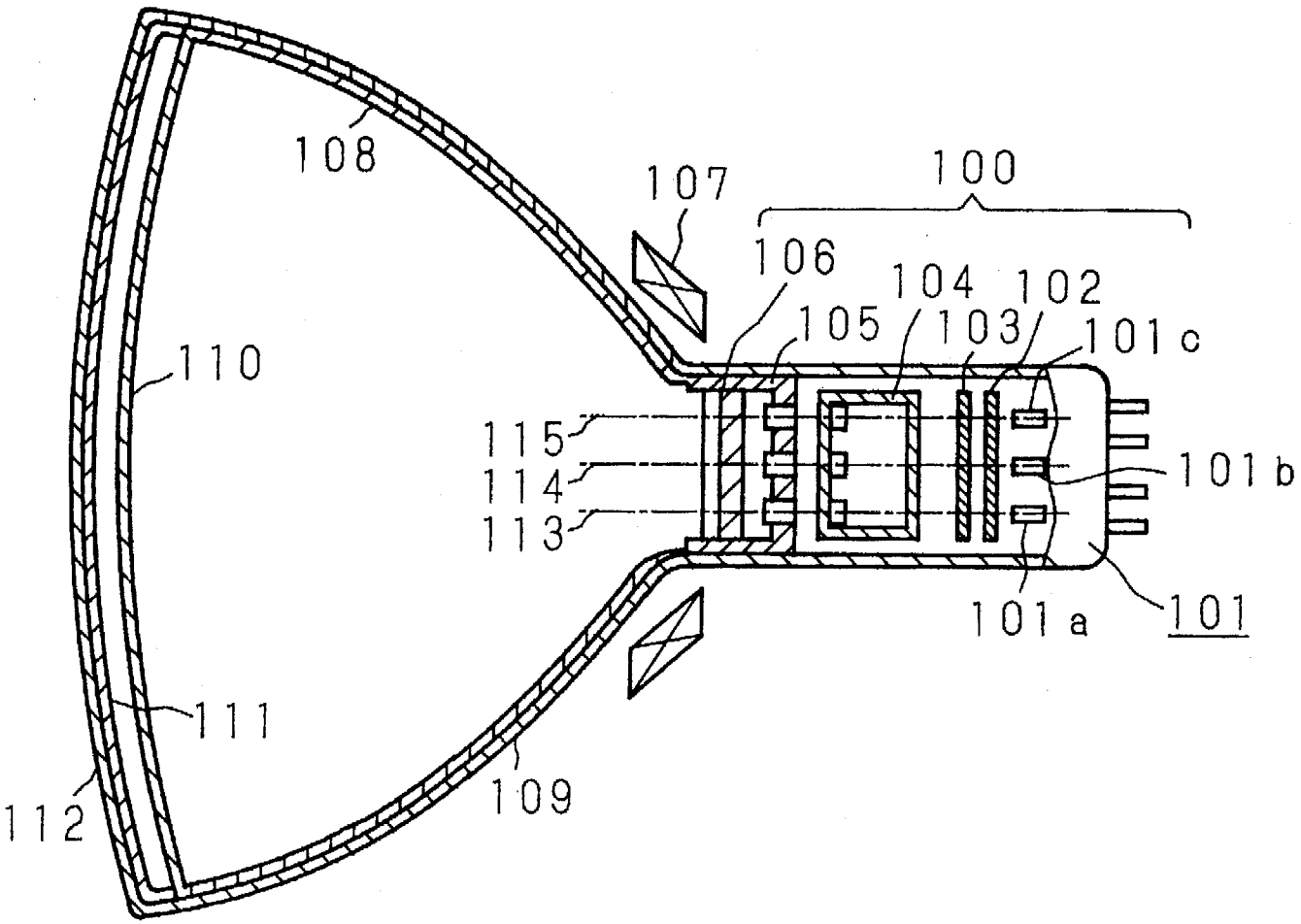
Fig. 1 Prior Art
FIG. 1 is a schematic section view showing the configuration of a color cathode-ray tube which uses a prior art electron gun.
Figure 2A:
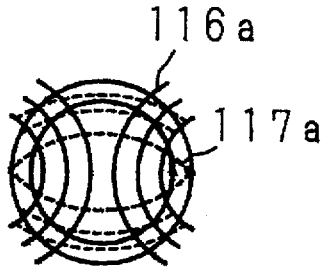
Fig. 2A Prior Art
FIG. 2A is a diagram showing an inhomogeneous magnetic field due to a deflection yoke.
Figure 2B:
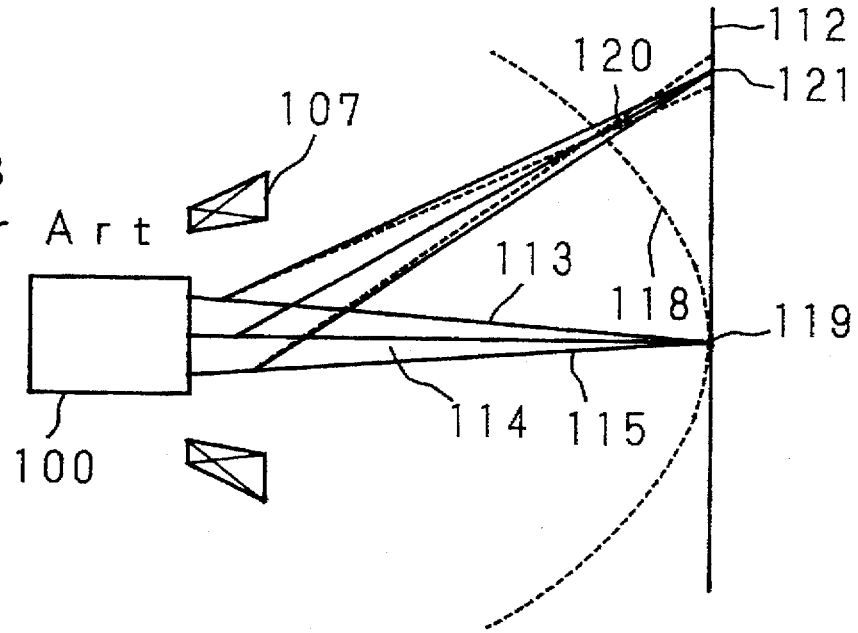
Fig. 2B Prior Art
FIG. 2B is a diagram showing the state of electron beams in an inhomogeneous magnetic field.
Figure 2C:
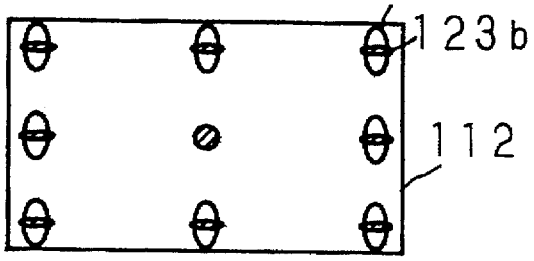
Fig. 2C Prior Art
FIG. 2C is a diagram showing beam spots projected to a face plate.
Figure 3A:
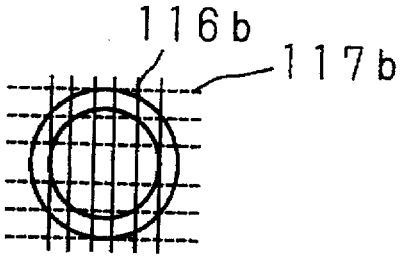
Fig. 3A Prior Art
FIG. 3A is a diagram showing a homogeneous magnetic field due to a deflection yoke.
Figure 3B:
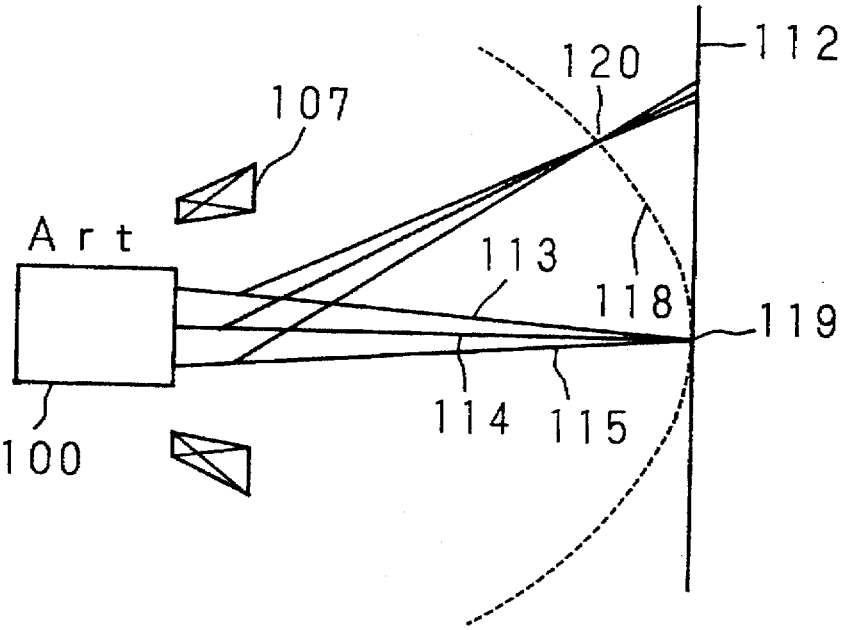
Fig. 3B Prior Art
FIG. 3B is a diagram showing the state of electron beams in a homogeneous magnetic field.
Figure 3C:
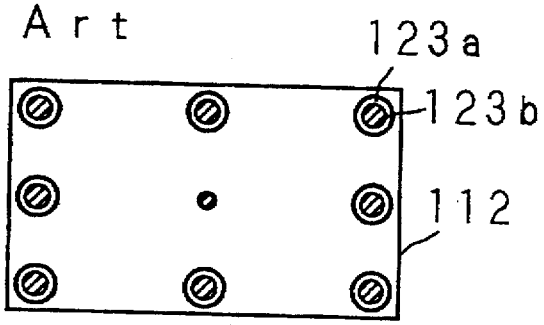
Fig. 3C Prior Art
FIG. 3C is a diagram showing beam spots projected to the face plate.
Figure 4A:
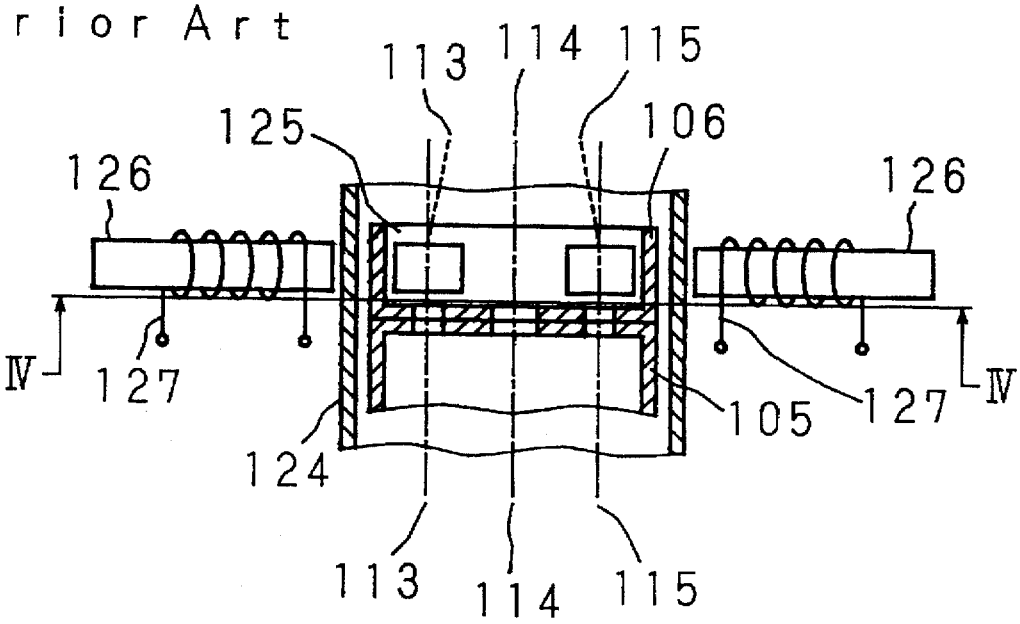
Fig. 4A Prior Art
FIG. 4A is a plan view showing the configuration of a device for carrying out the motion convergence of a color cathode-ray tube.
Figure 4B:
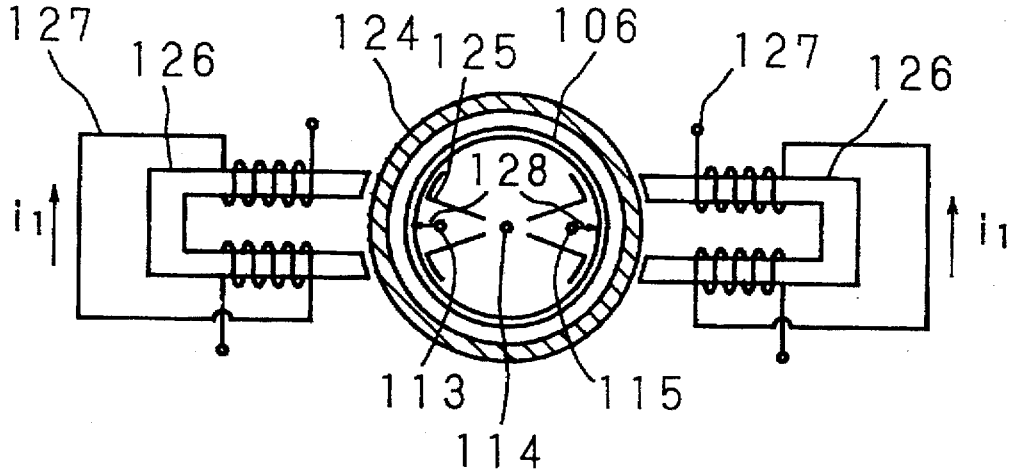
Fig. 4B Prior Art
FIG. 4B is a section view taken along the line IV—IV of FIG. 4A.
Figure 5A:
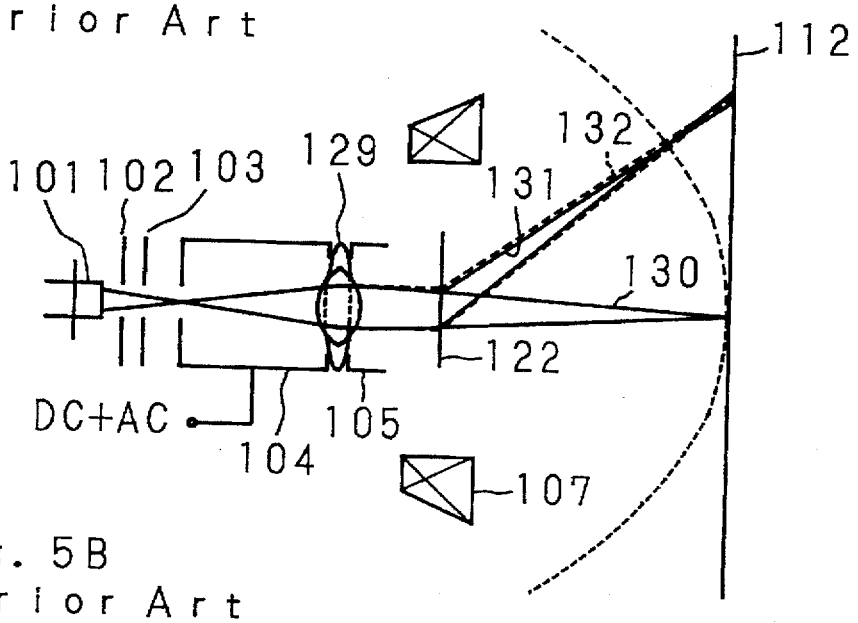
Fig. 5A Prior Art
FIG. 5A is a diagram illustrating the dynamic focusing function in a color cathode-ray tube.
Figure 5B:
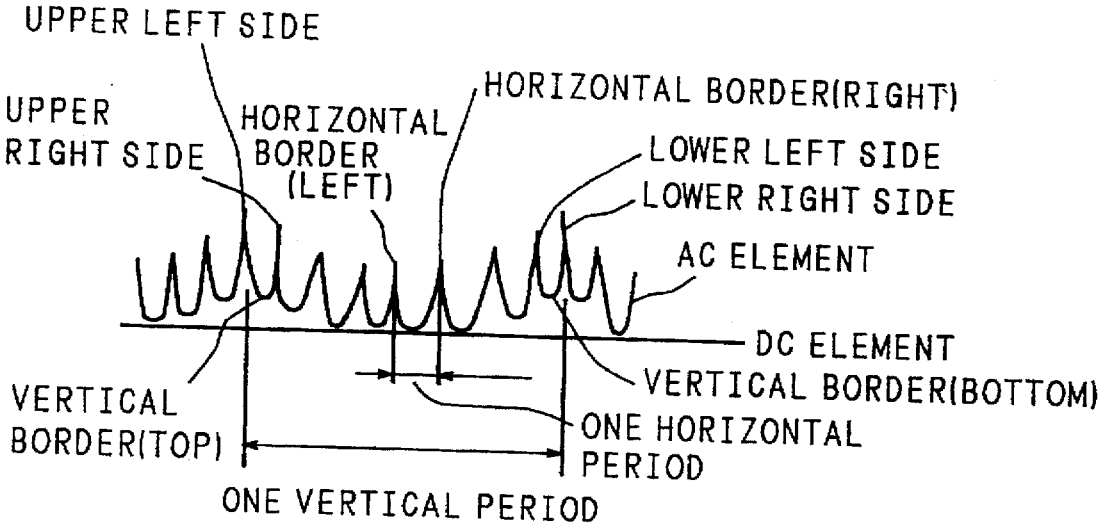
Fig. 5B Prior Art
FIG. 5B is a view illustrating an alternating current voltage which is superposed to a G3 electrode.
Figure 6A:
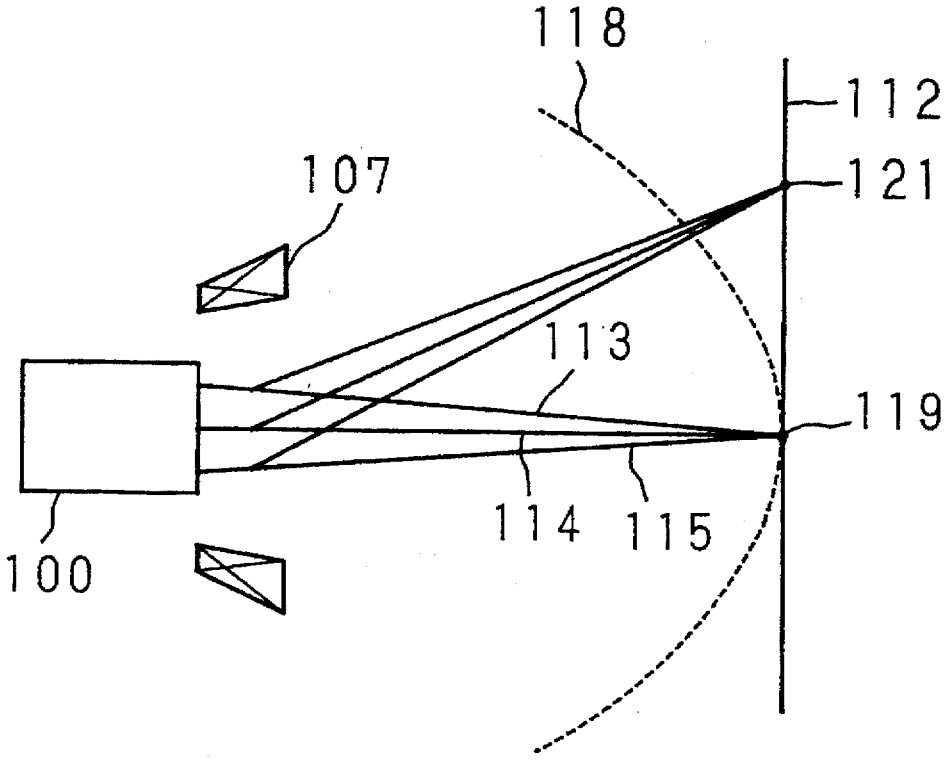
Fig. 6A Prior Art
FIG. 6A is a diagram explanatory of the converging and focusing functions on electron beams.
Figure 6B:
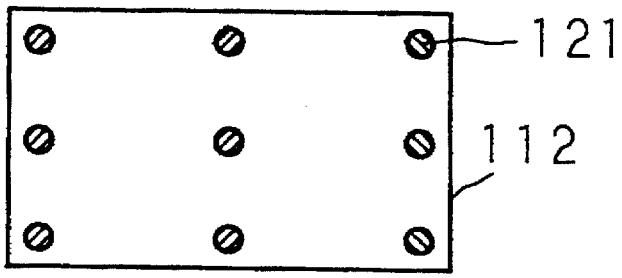
Fig. 6B Prior Art
FIG. 6B is a diagram illustrating beam spots projected to the face plate.
Figure 7A:
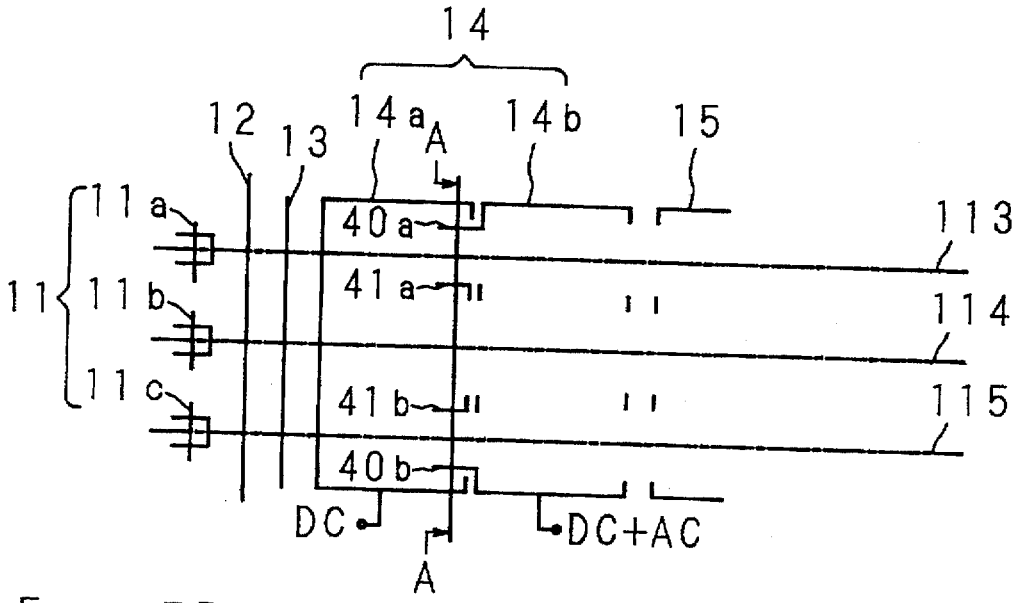
FIG. 7A is a diagram showing the configuration of an electron gun used in a cathode-ray tube of a first embodiment.
Figure 7B:
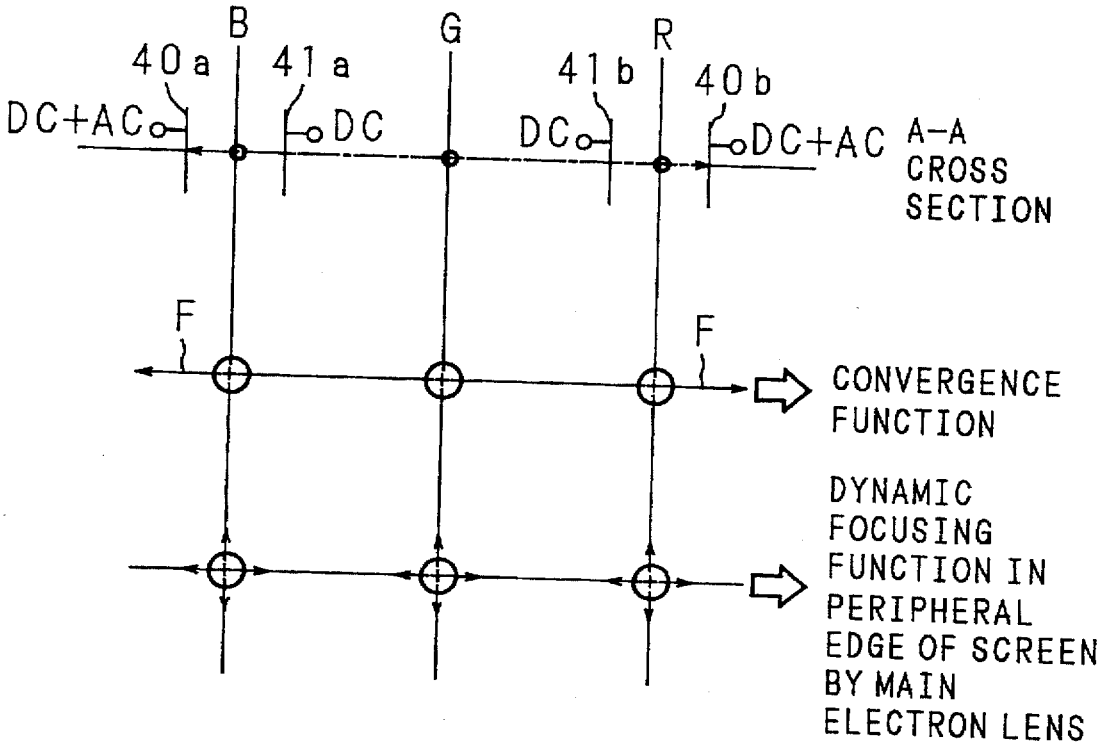
FIG. 7B is a diagram illustrating an effect on electron beams as viewed from the line A—A of FIG. 7A.

FIG. 7A is a diagram of the configuration of an electron gun used in a cathode-ray tube of a first embodiment of the invention, and FIG. 7B is a diagram illustrating an effect on electron beams as viewed from the line A—A of FIG. 7A. In the figures, 11 represents a cathode consisting of three cathodes which are heated by a heater (not shown) to emit electrons, that is, a cathode 11*a* for generating a RED beam 113, a cathode 11*b* for generating a GREEN beam 114, and a cathode 11*c* for generating a BLUE beam 115. At the emission side of the cathode 11, a G1 electrode 12 for controlling the quantity of the emitted electron beams, a G2 electrode 13 for accelerating the controlled electron beams, a G3 electrode 14 for focusing accelerated electron beams, and a G4 electrode 15 are arranged in this sequence.

The G3 electrode 14 is split into a first G3 electrode 14*a* at the side of the G2 electrode, and a second G3 electrode 14*b* at the side of the G4 electrode. In the G3 electrode 14, first convergence electrodes 40*a* and 40*b* are disposed to be parallel to the side electron beams 113 and 115 of three electron beams outside the side beams 113 and 115. The first convergence electrodes 40*a* and 40*b* are electrically connected to the second G3 electrode 14*b*. Second convergence electrodes 41*a* and 41*b* are set inside the side beams 113 and 115 to be parallel to the side beams 113 and 115 and respectively opposite to the confronting first convergence electrodes 40*a* and 40*b*. The second convergence electrodes 41*a* and 41*b* are electrically connected to the first G3 electrode 14*a*.

The second G3 electrode 14*b* and the G4 electrode 15 constitute a main electron lens for focusing electron beams. The G4 electrode 105 is welded to a shield cup (not shown) to be electrically connected each other, and a high voltage of about 20 to 35 kV is applied to the G4 electrode from an anode button which is not shown through an inner duck. The cathode 11, the G1 electrode 12, the G2 electrode 13, the G3 electrode 14, the G4 electrode 15, and the shield cup constitute the electron gun of the embodiment.

The electron gun is inserted into a neck portion of a glass envelope of the color cathode-ray tube. The RED beam 113, the GREEN beam 114, and the BLUE beam 115 emitted from the electron gun are scanned by a deflection yoke attached to the outer periphery of the boundary between the neck portion and the funnel portion, to be cast to the inside of the face plate.

In the thus constructed device, when a direct current voltage (DC) is applied to the first G3 electrode 14*a*, and a voltage (DC+AC) obtained by superposing an alternating current voltage (AC) synchronized with the deflection current is applied to the second G3 electrode 14*b* constituting the main electron lens, a potential difference which is increased as the electron beams are deflected to the vicinity of the peripheral edge of the face plate (not shown) is generated between opposing first and second convergence electrodes of each pair (i.e., between the first convergence electrode 40*a* and the second convergence electrode 41*a*, and between the first convergence electrode 40*b* and the second convergence electrode 41*b*), thereby producing a dipole electric field.

Figure 7C:
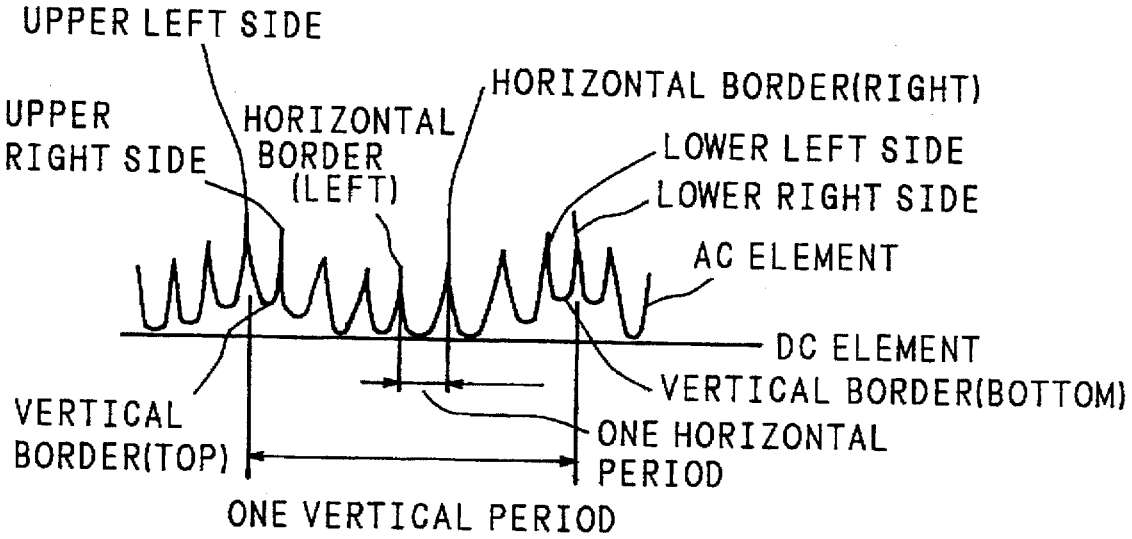
FIG. 7C is a view illustrating an alternating current voltage which is superposed to a G3 electrode of the first embodiment.

FIG. 7C is a diagram illustrating the alternating current voltage to be superposed. As described above, the alternating current voltage to be supplied to the second G3 electrode 14*b* is synchronized with the deflection current, because the amount of the missed convergence of the three electron beams is proportional to the deflecting degree of the electron beams, and the deflecting degree of the electron beams is proportional to the level of the deflection current supplied to the deflection yoke. Accordingly, during the period while the electron beams are deflected to the vicinity of the peripheral edge of the face plate 112 or the deflecting of the electron beams is large, the alternating current voltage is allowed to correspond to the deflection current, thereby correcting the amount of the missed convergence.

As shown in FIG. 7B, the dipole electric field generates forces of which respectively act to the side beams 113 and 115 to increase the distance between the two beams. This creates the same effect as that produced by the motion convergence function by the pole pieces described earlier.

In the vicinity of the peripheral edge of the face plate, the function of the main electron lens constituted of the second G3 electrode 14*b* and the G4 electrode 15 is weakened by the alternating current voltage (AC) superposed to the second G3 electrode 14*b*. Accordingly, it is possible to cast the electron beams in focus similar to the dynamic focusing operation in the prior art.

As described above, according to the invention, the G3 electrode is split into two parts, each of the split electrodes is provided with convergence electrodes to set the side beams pass therebetween, an alternating current voltage synchronized with the deflection current is applied to one of the split electrodes which constitutes the main electron lens, and a direct current voltage is applied to the other split electrode. In the arrangement as above, the dynamic focusing function and the motion convergence function can simultaneously be effected by one superposed alternating current voltage.

In the device constituted as above, the convergence electrodes 40 and 41 work as a quadrupole lens. Although it is very small, a force by the quadrupole electric field is exerted on the electron beams. More specifically, the force is effective to converge the electron beams in the vertical direction and to diverge the electron beams in the horizontal direction, which however distorts the beam spots in the vicinity of the peripheral edge of the face plate. it is consequently desired to eliminate the force of the quadrupole electric field. An electron gun which can eliminate the function of the quadrupole lens will be described as Embodiment 2.

Embodiment 2

Figure 8A:
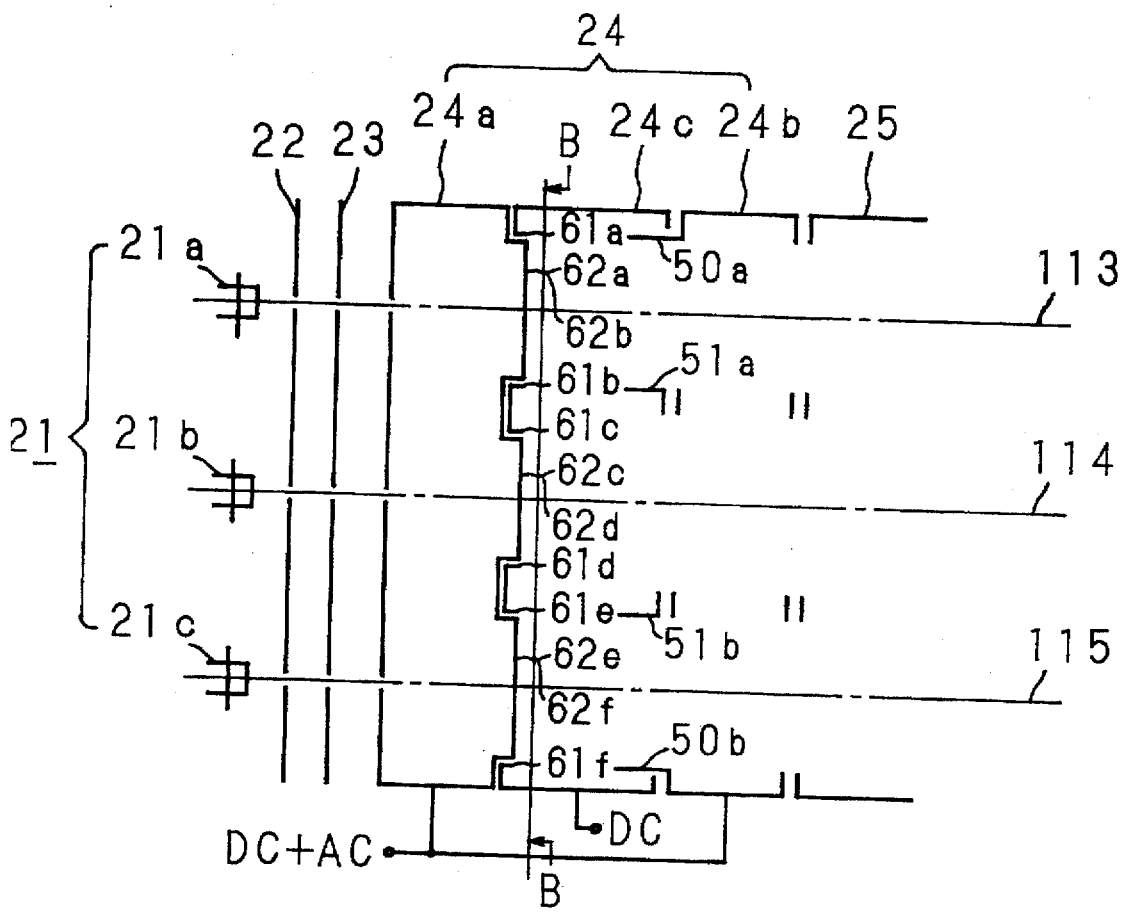
FIG. 8A is a diagram showing the configuration of an electron gun used in a cathode-ray tube of a second embodiment.
Figure 8B:
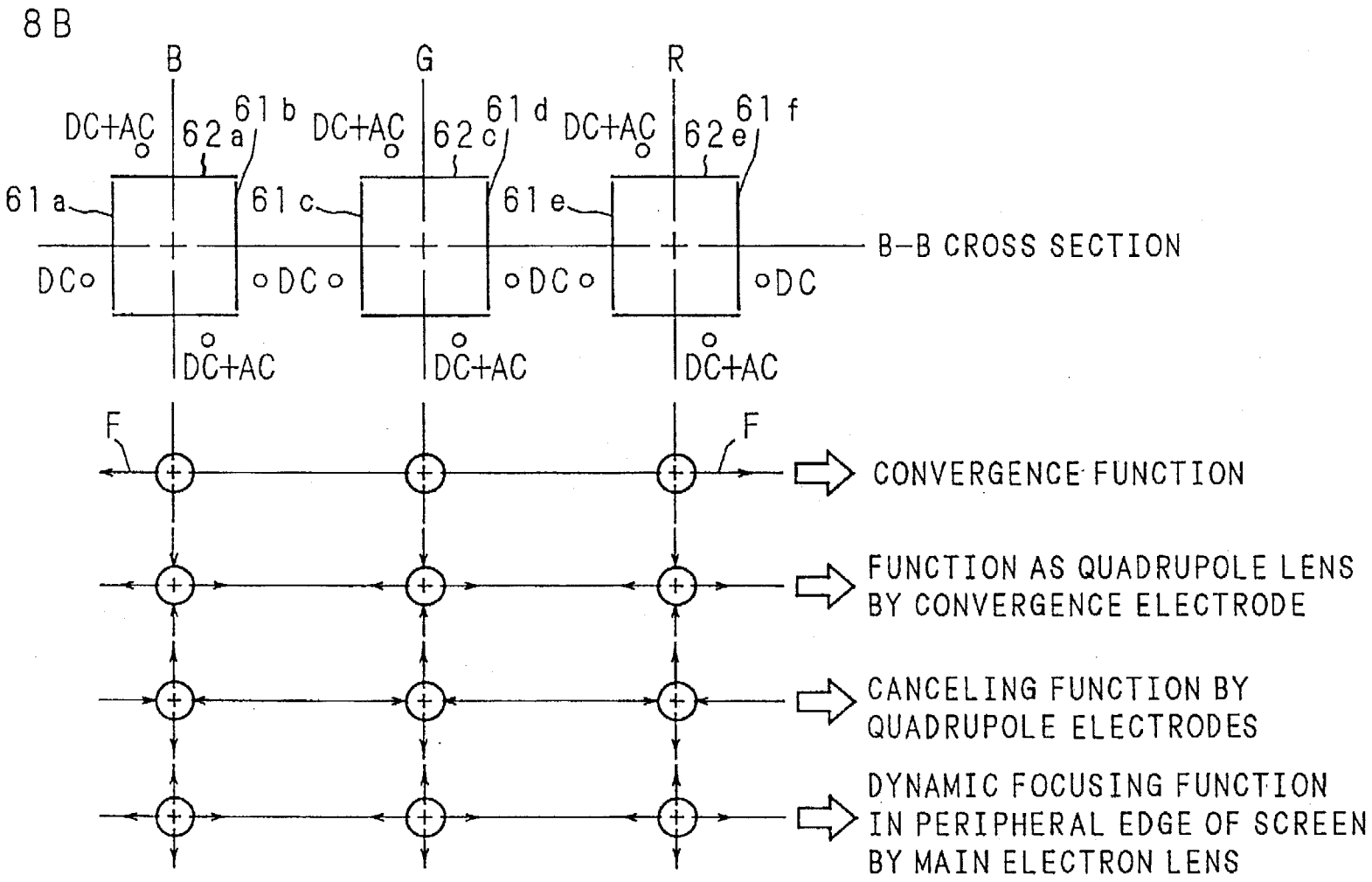
FIG. 8B is a diagram illustrating an effect on electron beams as viewed from the line B—B of FIG. 8A.

FIG. 8A is a diagram showing the configuration of an electron gun used in a cathode-ray tube of a second embodiment of the invention, and FIG. 8B is a diagram illustrating an effect on electron beams as viewed from the line B—B of FIG. 8A. In the FIGS, 24*a*, 24*b*, and 24*c* respectively indicate three electrodes split from a G3 electrode, namely, the first G3 electrode 24*a* disposed at the side of a G2 electrode 23, the third G3 electrode 24*b* at the side of a G4 electrode 25, and the second G3 electrode 24*c* interposed between the first and third electrodes.

In the G8 electrode 24, first convergence electrodes 50*a* and 50*b* are installed outside the side beams 113 and 115 in parallel to the side beams 113 and 115. The convergence electrodes 50*a* and 50*b* are electrically connected to the third G3 electrode 24*b*. Second convergence electrodes 51*a* and 51*b* are set inside the side beams 113 and 115 and parallel to the side beams, and respectively opposite to the first convergence electrodes 50*a* and 50*b*. The convergence electrodes 51*a* and 51*b* are electrically connected to the first G3 electrode 24*a*.

Moreover, in the G3 electrode 24, first plate-like electrodes 61*a*, 61*b*, 61*c*, 61*d*, 61*e* and 61*f* are disposed in such a manner to confront each other in pairs. The electron beams 113, 114 and 115 respectively pass between the corresponding pairs of plate-like electrodes 61*a* and 61*b*, 61*c* and 61*d*, and 61*e* and 61*f*. The first plate-like electrodes are electrically connected to the second G3 electrode 24*c*. Second plate-like electrodes 62*a*, 62*b*, 62*c*, 62*d*, 62*e* and 62*f* are faced to each other in pairs to enclose the electron beams square in cooperation with the first. plate-like electrodes 61*a* to 61*f*. The second plate-like electrodes are electrically connected to the first G3 electrode 24*a*. These quadrupole electrodes each composed of four electrodes consist of the first and second plate electrodes 61*a* to 61*f*, and 62*a* to 62*f*.

The other parts are in the same constitution as in the first embodiment. Corresponding parts are designated by the same reference numerals, and the description is omitted.

In the above electron gun, when a direct current voltage (DC) is applied to the second G3 electrode 24*c*, and a voltage (DC+AC) obtained by superposing an alternating current voltage (AC) synchronized with the deflection current is applied to the first G3 electrode 24*a* and the third G3 electrode 24*b*, as shown in FIG. 8B, the motion convergence function and the dynamic focusing function are exerted to the electron beams by the first and second convergence electrodes 50*a*, 50*b*, 51*a*, and 51*b*.

As shown in FIG. 8B, the first plate 61 and the second plate 62 produces quadrupole electric field which cancels the very small quadrupole electric field accompanyingly produced by the convergence electrodes 50, 51, thereby the distortion of the beam spots in the vicinity of the peripheral edge of the face plate being prevented.

In Embodiments 1 and 2 described hereinabove, there is brought about a difference in level of the operation as a quadrupole lens between the center beam and the side beams. Although the difference is small, the force due to the quadrupole electric field which is exerted onto the side beams 113 and 115 is greater than that acting to the center beam 114. In the vicinity of the peripheral edge of the face plate, this difference causes the converging state of beam spots to be varied between the center beam 114 and the side beams 113 and 115, leading to the deterioration of resolution. Therefore, as it is desired to eliminate the difference in the operation of the quadrupole lens, an electron gun capable of removing the above difference wilt be described as Embodiment 3.

Embodiment 3

Figure 9:
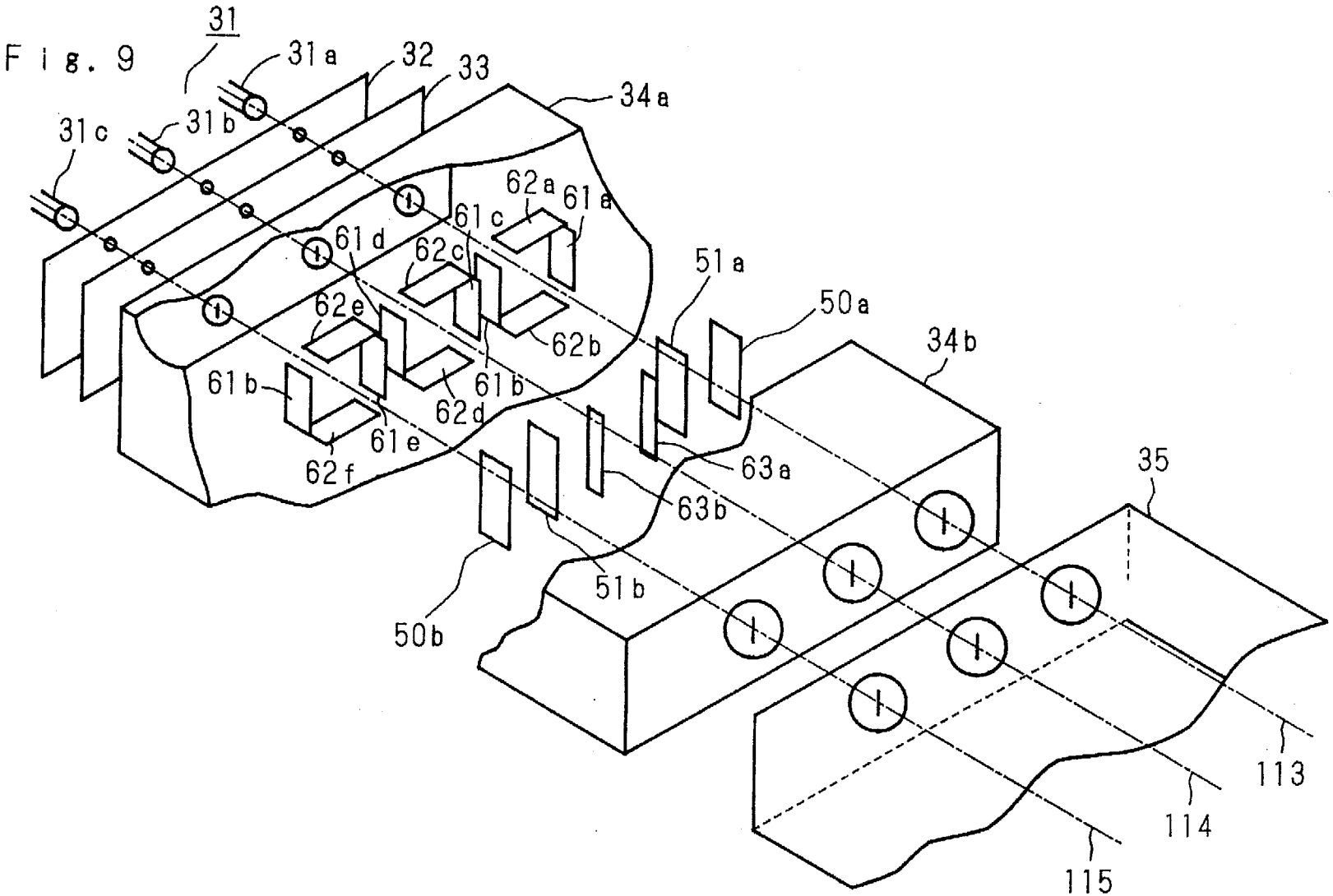
FIG. 9 is a perspective view showing the configuration of an electron gun used in a cathode-ray tube of a third embodiment.
Figure 10A:
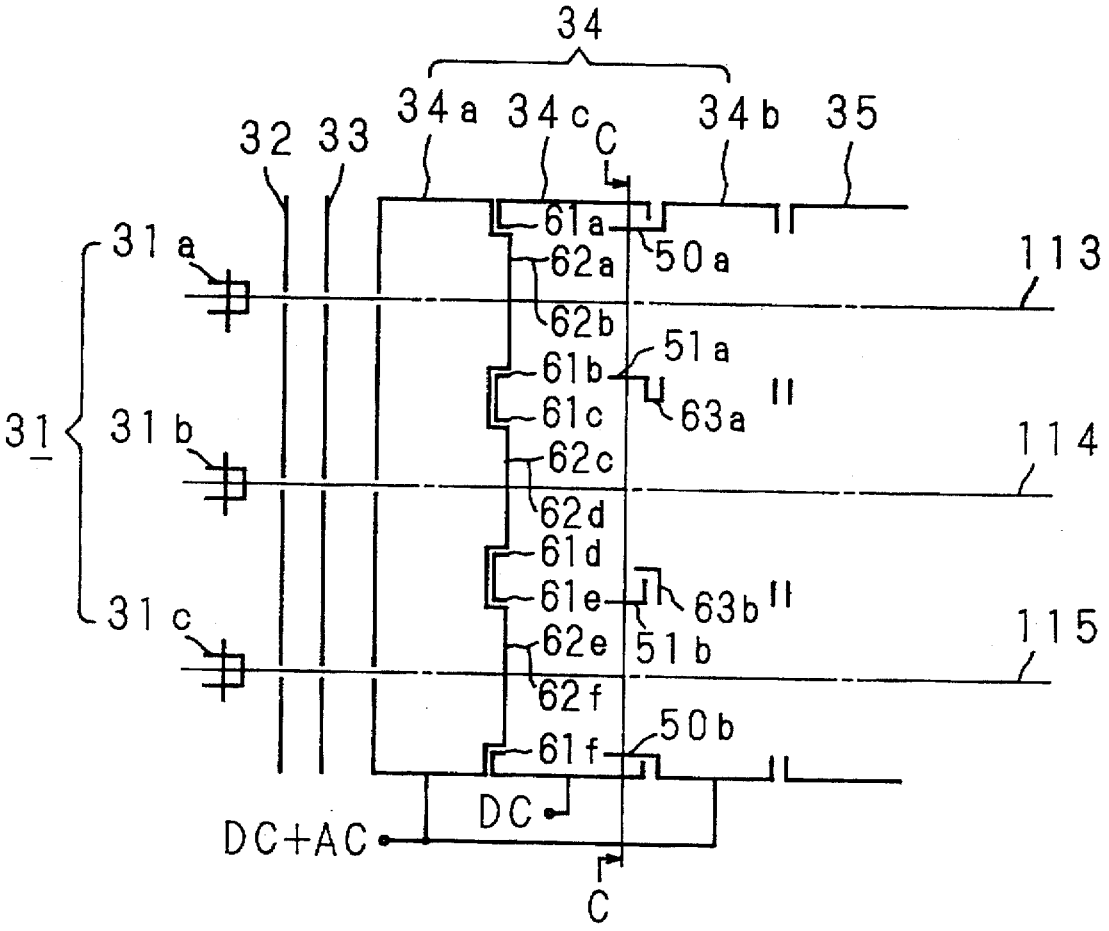
FIG. 10A is a diagram showing the configuration of the electron gun used in the cathode-ray tube of the third embodiment.
Figure 10B:
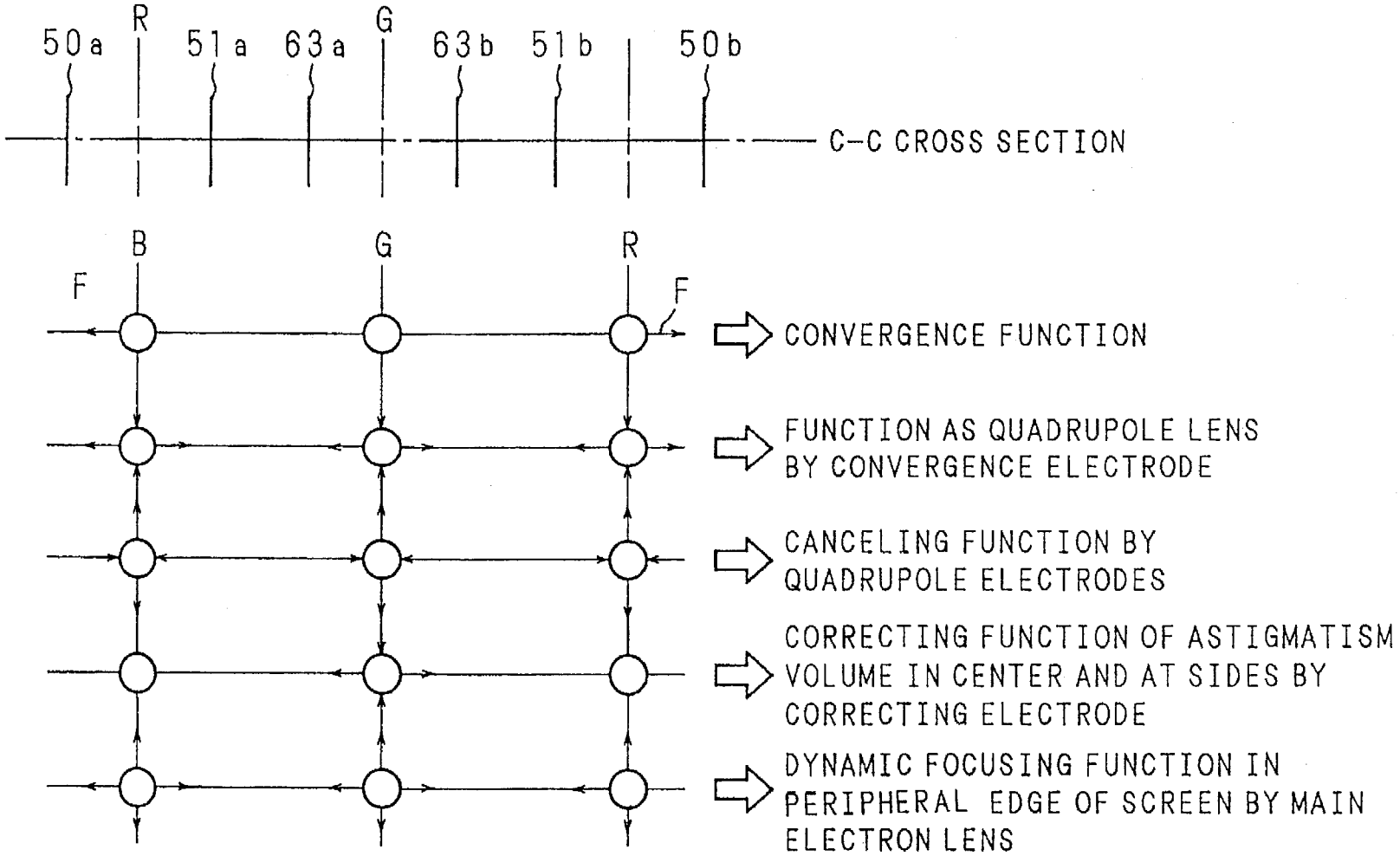
FIG. 10B is a diagram illustrating an effect on electron beams as viewed from the line C—C of FIG. 10A.
Figure 11:
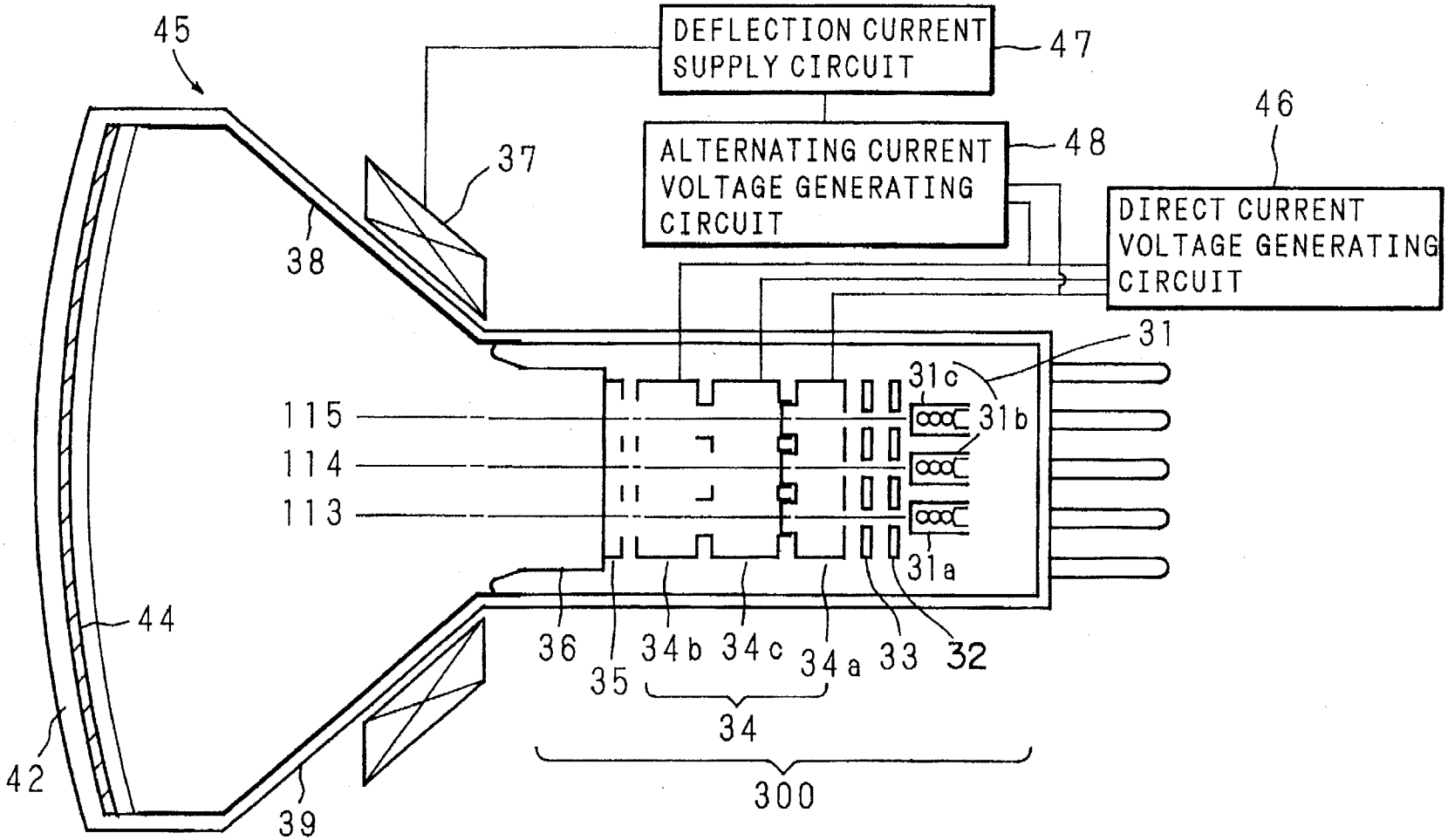
FIG. 11 is a schematic section view showing the configuration of an image display device of the third embodiment.

FIG. 9 is a perspective view showing the configuration of an electron gun used in a cathode-ray tube of a third embodiment of the invention, FIG. 10A is a diagram showing the configuration of the electron gun, FIG. 10B illustrates an effect on electron beams as viewed from the line C—C of FIG. 10A and FIG. 11 is a schematic section view showing the configuration of an image display device using the electron gun. In the figures, 39 shows a glass envelope. An inner duck 38 is formed inside a funnel portion of the glass envelope 39, and a face plate 42 is mounted at the opening of the funnel portion. An electron gun 300 is set at the neck portion of the glass envelope 39. A cathode 31 provided at the opening of the neck portion consists of three cathodes which are heated by a heater (not shown) to emit electrons, i.e., a cathode 31*a* for generating a RED beam 113, a cathode 31*b* for generating a GREEN beam 114, and a cathode 31*c* for generating a BLUE beam 115. At the emission side of the cathode 31, a G1 electrode 32 for controlling the quantity of the emitted electron beams, a G2 electrode 33 for accelerating the controlled electron beams, a G3 electrode 34 for focusing accelerated electron beams, a G4 electrode 35, and a shield cup 36 are arranged in this sequence. The G3 electrode 34 and the G4 electrode 35 constitute a main electron lens for focusing the electron beams.

The G3 electrode is divided into three parts, namely, a first G3 electrode 34*a* disposed at the side of the G2 electrode 33, a third G3 electrode 34*b* at the side of the G4 electrode 35, and a second G3 electrode 34*c* between the first and third electrodes. Inside the G3 electrode 34 are first convergence electrodes 50*a* and 50*b* so positioned outside the side beams 113 and 115 as to be parallel to the side beams 113 and 115. The convergence electrodes 50*a* and 50*b* are electrically connected to the third G3 electrode 34*b*. Second convergence electrodes 51*a* and 51*b* are mounted inside the side beams 113 and 115 to be parallel to the side beams 113 and 115 and respectively opposite to the first convergence electrodes 50*a* and 50*b*. The convergence electrodes 51*a* and 51*b* are electrically connected to the first G3 electrode 34*a*. Furthermore, correction electrodes 63*a* and 63*b* are set to pass the center electron beam 114 therebetween. The correction electrodes 63*a* and 63*b* are electrically connected to the third G3 electrode 34*b*.

In the G3 electrode 34, first plate-like electrodes 61*a*, 61*b*, 61*c*, 61*d*, 61*e* and 61*f* are disposed in such a manner as to be faced to each other in pairs. The electron beams 113, 114 and 115 pass between the respective pairs of plate-like electrode pairs 61*a* and 61*b*, 61*c* and 61*d*, and 61*e* and 61*f*. The first plate-like electrodes are electrically connected to the second G3 electrode 34*c*. Second plate-like electrodes 62*a*, 62*b*, 62*c*, 62*d*, 62*e* and 62*f* are so arranged as to confront each other in pairs. The second electrodes 62*a* to 62*f* cooperate with the first plate-like electrodes 61*a* to 61*f* to enclose the corresponding electron beams square. The second plate-like electrodes are electrically connected to the first G3 electrode 34*a*. The first and second plate electrodes 61*a* to 61*f*, and 62*a* to 62*f* constitute quadrupole electrodes.

The G4 electrode 35 is welded to the shield cup 36 to be electrically connected each other, and a high voltage of about 20 to 35 kV is applied to the G4 electrode 35 from an anode button which is not shown, through the inner duck 38. The cathode 31, the G1 electrode 32, the G2 electrode 33, the G3 electrode 34, the G4 electrode 35, and the shield cup 36 constitute the electron gun 300.

A fluorescent material 43 which emits light of colors when receiving the RED beam 113, the GREEN beam 114, and the BLUE beam 115 is provided inside the face plate 42. A mosaic shadow mask 44 is arranged inside the fluorescent material to confront the face plate 42. A deflection yoke 37 for scanning electron beams is attached in the outer periphery of the boundary between the neck portion of the glass envelope 39 and the funnel portion, thereby constituting the color cathode-ray tube 45.

The image display device comprises a direct current, voltage generating circuit 46 for applying a direct current voltage to the first to third G3 electrodes 34*a* to 34*c*, a deflection current supply circuit 47 for supplying to the deflection yoke 37 a deflection current to deflect the three electron beams, and an alternating current voltage generating circuit 48 for generating an alternating current voltage which is synchronized with the deflection current and applied to the first and third G3 electrodes 34*a* and 34*b*.

In the device of the above constitution, when the direct current voltage generating circuit 46 applies a direct current voltage to the second G3 electrode 34*c* and the alternating current voltage generating circuit, 48 applies to the first and third G3 electrodes 34*a* and 34*b* a voltage (AC+DC) obtained by superposing an alternating current voltage synchronized with the deflection current, the motion convergence function and the dynamic focusing function are displayed by the first and second convergence electrodes 50 and 51 as described in conjunction with the first embodiment, and the function as the quadrupole lens due to the convergence electrodes can be corrected by the quadrupole electrodes 61 and 62 as described in the second embodiment. Furthermore, according to the embodiment, the difference of the operation as the quadrupole lens can be corrected by the correction electrodes 63 as shown in FIG. 10B.

Next, a specific example of the third embodiment will be described together with experimental values.

The experiment was conducted on a cathode-ray tube the deflection of 21 hour and 90 degree. Then the focus voltage was 25% of the high voltage, the distance between the middle point of the third G3 electrode 34*b* and the G4 electrode 35 and the convergence electrodes 50 and 51 was about 10 mm, the position of the quadrupole electrodes 61 and 62 was 16 mm, the length of the outer convergence electrode 50 in the traveling direction of electrodes was about 2 mm, the length of the inner convergence electrode 51 in the traveling direction of electrons was about 1.5 mm, the length of the quadrupole electrodes 61 and 62 also the traveling direction of electrons was about 0.8 mm, and the length of the correction electrodes 63 in the traveling direction of electrons was about 0.3 mm. It was confirmed that the beam spots were focused without distortion in the whole area of the face plate superposing a modulation voltage of 300 to 500 V in the present device.

In the foregoing description, a bipotential type electron gun having G1 to G4 electrodes is used. The invention may be applied also to a multistage convergent electron gun having G1 to G6 electrodes, with the same functions and effects achieved. In the above application, the convergence electrodes, the quadrupole electrodes, and the correction electrodes are formed in the G5 electrode constituting a main electron lens in combination with the G6 electrode to which a high voltage is applied.

In the electron gun, color cathode-ray tube and image display device of the invention, convergence electrodes so paired as to pass the side electron beams therebetween are fitted in the focusing electrode, and an alternating current voltage synchronized with the deflection current is superposed to one of the convergence electrodes in pairs. Accordingly, the three electron beams can be focused without distortion in the whole area of the face plate in the simple structure. Furthermore, the adjustment can be achieved more easily than in a conventional motion convergence device, and the power consumption can be reduced.

In the electron gun, color cathode-ray tube and image display device of the invention, quadrupole electrodes which enclose the three electron beams square are disposed in the focusing electrode, and an alternating current voltage synchronized with the deflection current is superposed to one of each pair of the quadrupole electrodes confronting each other via the electron beams. Accordingly, a very small distortion of the electron beams due to the convergence electrodes can be corrected, thus ensuring electron beam spots of higher quality in the whole area of the face plate.

Moreover, in the electron gun, color cathode-ray tube and image display device of the invention, a pair of correction electrodes are disposed in the focusing electrode to pass the center beam of the three electron therebetween, and an alternating current volt, age synchronized with the deflection current is superposed to the correction electrodes. Therefore, it is possible to cancel the difference in level of the function of the quadrupole lens between the center beam and the side beams, whereby electron beam spots of higher quality are obtained in the whole area of the face plate.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An electron gun comprising:

a cathode for emitting three electron beams including a center electron beam and two side electron beams on a horizontal plane;

a control electrode for controlling the electron beams emitted from said cathode;

an accelerating electrode for accelerating the beams controlled by said control electrode;

a focusing electrode for focusing the beams accelerated by said accelerating electrode;

a high voltage electrode forming a main electron lens with the focusing electrode; and pairs of convergence electrodes disposed in said focusing electrode in the same direction as that of arrangement of three electron beams emitted by said cathode to hold respective said two side electron beams therebetween;

wherein only a direct-current focusing voltage is applied to the convergence electrodes adjacent the center electron beam, and a voltage obtained by superposing an alternating current voltage synchronized with a deflection current to said direct current focusing voltage is applied to the others of said convergence electrodes adjacent to only respective said two side electron beams.

2. The electron gun according to claim 1, wherein said convergence electrodes are parallel to the side electron beams.

3. The electron gun according to claim 1, wherein said focussing electrode further comprises a first focussing electrode and a second focussing electrode, convergence electrodes inside the side electron beams are electrically connected to said first focussing electrode closer to said cathode and convergence electrodes outside the side electron beams are electrically connected to said second focussing electrode further from said cathode.

4. The electron gun according to claim 1, further comprising;

two pairs of quadrupole electrodes disposed closer to said accelerating electrode than said convergence electrodes are, in said focusing electrode to enclose each of said three electron beams right-to-left and above-to-below, wherein said direct current focusing voltage is applied to quadrupole electrodes which are disposed at the right and left side of the electron beam and, a voltage obtained by superposing an alternating current voltage synchronized with a deflection current to said direct current focusing voltage is applied to the quadrupoles disposed above and below the electron beam.

5. The electron gun according to claim 4, further comprising:

a pair of correction electrodes disposed in said focusing electrode in the same direction as that of the arrangement of the three electron beams to hold the center electron beam therebetween, wherein a voltage obtained by superposing an alternating current voltage synchronized with a deflection current to said direct current focusing voltage, is applied to said correction electrodes.

6. A color cathode-ray tube comprising:

an electron gun including a cathode for emitting three electron beams including a center electron beam and two side electron beams on a horizontal plan, a control electrode for controlling the electron beams emitted from said cathode, an accelerating electrode for accelerating the beams controlled by said control electrode, a focusing electrode for focusing the beams accelerated by said accelerating electrode, a high voltage electrode forming a main electron lens with the focusing electrode, and pairs of convergence electrodes disposed in said focusing electrode in the same direction as that of arrangement of three electron beams emitted by said cathode to hold respective said two side electron beams therebetween, wherein only a direct-current focusing voltage is applied to the convergence electrodes adjacent the center electron beam, and a voltage obtained by superposing an alternating current voltage synchronized with a deflection current to said direct current focusing voltage is applied to the others of said convergence electrodes adjacent to only respective said two side electron beams;

a screen having a fluorescent material on which said electron beams impinge; and a deflection yoke generating a homogeneously-deflected magnetic field to deflect said three electron beams emitted from said electron gun.

7. The color cathode-ray tube according to claim 6, wherein said convergence electrodes are parallel to the side electron beams.

8. The color cathode-ray tube according to claim 6, wherein said focussing electrode further comprises a first focussing electrode closer to said cathode and a second focussing electrode further from said cathode, convergence electrodes inside the side electron beams are electrically connected to said first focussing electrode, and convergence electrodes outside the side electron beams are electrically connected to said second focussing electrode.

9. The color cathode-ray tube according to claim 6, wherein the electron gun further includes two pairs of quadrupole electrodes disposed closer to said accelerating electrode than said convergence electrodes are, in said focusing electrode to enclose each of said three electron beams right-to-left and above-to-below, wherein said direct current focusing voltage is applied to quadrupole electrodes which are disposed at the right and left side of the electron beam and, a voltage obtained by superposing an alternating current voltage synchronized with a deflection current to said direct current focusing voltage is applied to the quadrupoles disposed above and below the electron beam.

10. The color cathode-ray tube according to claim 9, wherein said electron gun further includes a pair of correction electrodes disposed in said focusing electrode in the same direction as that of the arrangement of the three electron beams to hold the center electron beam therebetween, wherein a voltage obtained by superposing an alternating current voltage synchronized with a deflection current to said direct current focusing voltage, is applied to said correction electrodes.

11. An image display device comprising:

an electron gun including a cathode for emitting three electron beams including a center electron beam and two side electron beams on a horizontal plan, a control electrode for controlling the electron beams emitted from said cathode, an accelerating electrode for accelerating the beams controlled by said control electrode, a focusing electrode for focusing the beams accelerated by said accelerating electrode, a high voltage electrode forming a main electron lens with the focusing electrode, and pairs of convergence electrodes disposed in said focusing electrode in the same direction as that of arrangement of three electron beams emitted by said cathode to hold respective said two side electron beams therebetween, wherein only a direct-current focusing voltage is applied to the convergence electrodes adjacent the center electron beam, and a voltage obtained by superposing an alternating current voltage synchronized with a deflection current to said direct current focusing voltage is applied to the others of said convergence electrodes adjacent to only respective said two side electron beams;

a screen having a fluorescent material on which said three electron beams impinge;

a deflection yoke which generates a homogeneously-deflected magnetic field to deflect said three electron beams emitted from said electron gun;

a deflection current supply circuit supplying a deflection current to said deflection yoke; and an alternating current voltage generation circuit generating an alternating current voltage which is synchronized with said deflection current and superposed to only one convergence electrode in each pair of said convergence electrodes.

12. The image display device according to claim 11, wherein said convergence electrodes are parallel to the side electron beams.

13. The image display device according to claim 11, wherein said focussing electrode further comprises a first focussing electrode closer to said cathode and a second focussing electrode further from said cathode, convergence electrodes inside the side electron beams are electrically connected to said first focussing electrode, and convergence electrodes outside the side electron beams are electrically connected to said second focussing electrode.

14. The image display device according to claim 11, wherein the electron gun further includes two pairs of quadrupole electrodes disposed closer to said accelerating electrode than said convergence electrodes are, in said focusing electrode to enclose each of said three electron beams right-to-left and above-to-below, wherein said direct current focusing voltage is applied to quadrupole electrodes which are disposed at the right and left side of the electron beam and, a voltage obtained by superposing an alternating current voltage synchronized with a deflection current to said direct current focusing voltage is applied to the quadrupoles disposed above and below the electron beam.

15. The image display device according to claim 14, wherein said electron gun further includes a pair of correction electrodes disposed in said focusing electrode in the same direction as that of the arrangement of the three electron beams to hold the center electron beam therebetween, wherein a voltage obtained by superposing an alternating current voltage synchronized with a deflection current to said direct current focusing voltage, is applied to said correction electrodes.

16. A method of focussing electron beams comprising the steps of:

emitting, via a cathode, three electron beams including a center electron beam and two side electron beams on a horizontal plane;

controlling the electron beams emitted from the cathode via a control electrode;

accelerating the beams controlled by the control electrode via an accelerating electrode;

focusing the beams accelerated by the accelerating electrode via a focusing electrode;

forming a main electron lens with the focusing electrode and a high voltage electrode;

disposing pairs of convergence electrodes in said focusing electrode in the same direction as that of arrangement of three electron beams emitted via the cathode to hold respective said two side electron beams therebetween;

applying only a direct-current focusing voltage to the convergence electrodes adjacent the center electron beam; and applying a superposed voltage obtained by superposing an alternating current voltage synchronized with a deflection current to said direct current focusing voltage to the others of said convergence electrodes adjacent to only respective said two side electron beams.

17. The method according to claim 16, further comprising:

disposing two pairs of quadrupole electrodes closer to the accelerating electrode than the convergence electrodes are, in said focusing electrode to enclose each of said three electron beams right-to-left and above-to-below;

applying the direct current focusing voltage to quadrupole electrodes which are disposed at the right and left side of the electron beam; and applying the superposed voltage to the quadrupoles disposed above and below the electron beam.

18. The method according to claim 17, further comprising:

disposing a pair of correction electrods in the focusing electrode in the same direction as that of the arrangement of the three electron beams to hold the center electron beam therebetween; and applying the superposed voltage to the correction electrodes.

* * * * *